US006926653B2

(12) United States Patent
Georgiades

(10) Patent No.: US 6,926,653 B2
(45) Date of Patent: Aug. 9, 2005

(54) TWO PIECE PIN AND SLEEVE STRIPPING SYSTEM

(75) Inventor: Gregory Georgiades, Longmeadow, MA (US)

(73) Assignee: Winkler + Dunnebier, AG, Neuwied (DE)

( * ) Notice: Subject to any disclaimer, the term of this patent is extended or adjusted under 35 U.S.C. 154(b) by 0 days.

(21) Appl. No.: 10/310,095

(22) Filed: Dec. 4, 2002

(65) Prior Publication Data

US 2004/0110620 A1 Jun. 10, 2004

(51) Int. Cl.[7] ..... B31B 1/14
(52) U.S. Cl. ..... 493/82; 493/83; 493/373
(58) Field of Search ..... 493/82, 83, 373

(56) References Cited

U.S. PATENT DOCUMENTS 3,266,388 A * 8/1966 Jones ..... 493/373
3,671,033 A * 6/1972 Coast ..... 493/462
3,877,353 A * 4/1975 Smith et al. ..... 493/373
4,705,152 A * 11/1987 Linker et al. ..... 193/39
5,087,237 A * 2/1992 Nunley ..... 493/342
5,108,358 A * 4/1992 Mounce ..... 493/373
5,154,689 A * 10/1992 Modoux et al. ..... 493/342
5,300,009 A * 4/1994 Bittenbender ..... 493/373
5,895,584 A * 4/1999 Sakota ..... 219/86.24

* cited by examiner

*Primary Examiner*—Eugene Kim
(74) *Attorney, Agent, or Firm*—Shook, Hardy & Bacon L.L.P.

(57) ABSTRACT

A device for separating and stripping waste material from a blank during a carton or envelope manufacturing process is provided. The device includes first and second separating cylinders. At least one pin and sleeve assembly is coupled to the second separating cylinder, and includes a pin having a sleeve slidably coupled thereto. A tube or hollow bar is coupled to the separating cylinder, and has at least one aperture therein generally aligned with the pin and sleeve assembly. In separating the waste material from the blank, the pin couples the waste material to the second separating cylinder. A fluid such as compressed air is forced into the tube and directed through the aperture to slide the sleeve from a retracted position in which the pin is exposed to an extended position in which the pin is concealed, whereby the waste material is forcibly removed from the pin.

16 Claims, 4 Drawing Sheets

TWO PIECE PIN AND SLEEVE STRIPPING SYSTEM

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The present invention relates to a two piece pin and sleeve stripping system. In particular, this invention relates to stripping system that utilizes a concentrated stream of air to remove a folding carton or envelope waste material from a two piece pin that is mounted to a rotating separating cylinder.

In manufacturing folding cartons, envelopes or other similar items from a sheet or web, a waste product or skeleton is typically produced. Generally, a sheet is first cut into a blank, which is the pattern of the folding carton, envelope or other desired pattern using a die or other type of cutting device. After the blank is cut, a skeleton remains surrounding the blank or within the blank if a window portion is incorporated into the folding carton. To separate the skeleton from the blank using the devices of the prior art, both the skeleton and blank are fed into a separating mechanism. The separating mechanism typically includes an upper and a lower cylinder, with the lower cylinder having a plurality of two-piece pin and sleeve assemblies that extend therefrom. Each of the pin and sleeve assemblies include a pin with a sleeve slidably coupled thereto. As the skeleton is fed between the cylinders, the pins are arranged so they penetrate and couple the skeleton to the lower cylinder while the folding carton blank continues through the manufacturing process. The skeleton is removed from the lower cylinder by sliding the sleeve over the pin to force the skeleton from the pin.

Currently, different types of mechanisms have been used to slide the sleeve over the pin to remove the waste material from the pin. For instance, the sleeves may be slid over the pin through the use of magnetic force. Specifically, a magnet is mounted within the stripping device and uses its magnetic polarity to slide the sleeve over the pin. Using a magnet to remove the waste from the pin also suffers from a number of drawbacks. In particular, the magnets are sometimes heavy and difficult to mount within the cylinders of the stripping mechanism.

Further included in the current carton and envelope manufacturing processes are assemblies which transfer the blank and skeleton from the cutting mechanism to the separating mechanism. In some instances, the assembly is a guide roller assembly by which the blank and skeleton are moved or slid along a support plate by rollers. There is a danger in utilizing such a system that the blank and skeleton will not be moved precisely together, thereby not remaining in registration with one another. If the relative positioning of the blank and the skeleton are thus altered, there is a chance that the pins of the stripping device may inadvertently pierce, and thereby destroy, the blank instead of or in addition to piercing the skeleton.

Accordingly, there remains a need for a stripping system that will efficiently remove waste material from the pins of a two piece pin and sleeve assembly. The present invention fills this need, as well as various other needs.

BRIEF SUMMARY OF THE INVENTION

In order to overcome the above-stated problems and limitations, and to achieve the noted objects, there is provided a device for separating and stripping waste material from a blank during a carton or envelope manufacturing process.

In general, the device includes first and second separating cylinders. At least one pin and sleeve assembly is coupled to the second separating cylinder and includes a sleeve slidably coupled with a pin. Further, a tube or hollow bar having first and second ends is coupled to the second separating cylinder and has at least one slot formed therein. This tube may extend within an interior portion of the second separating cylinder and may extend across a substantial length thereof. Further, the slots may be generally aligned with the pin and sleeve assembly. In stripping the waste material from the blank, the pin is used to couple the waste material to the second separating cylinder. A fluid such as compressed air is then forced into first and second ends of the tube and proceeds to flow out of the slot to slide the sleeve over the pin. The sleeve thus operates to strip the waste material from the pin.

Further objects, features, and advantages of the present invention over the prior art will become apparent from the detailed description of the drawings which follows, when considered with the attached figures.

BRIEF DESCRIPTION OF THE SEVERAL VIEWS OF THE DRAWINGS

In the accompanying drawings which form a part of the specification and are to be read in conjunction therewith and in which like reference numerals are employed to indicate like parts in the various views.

DETAILED DESCRIPTION OF THE INVENTION

Figure 1:
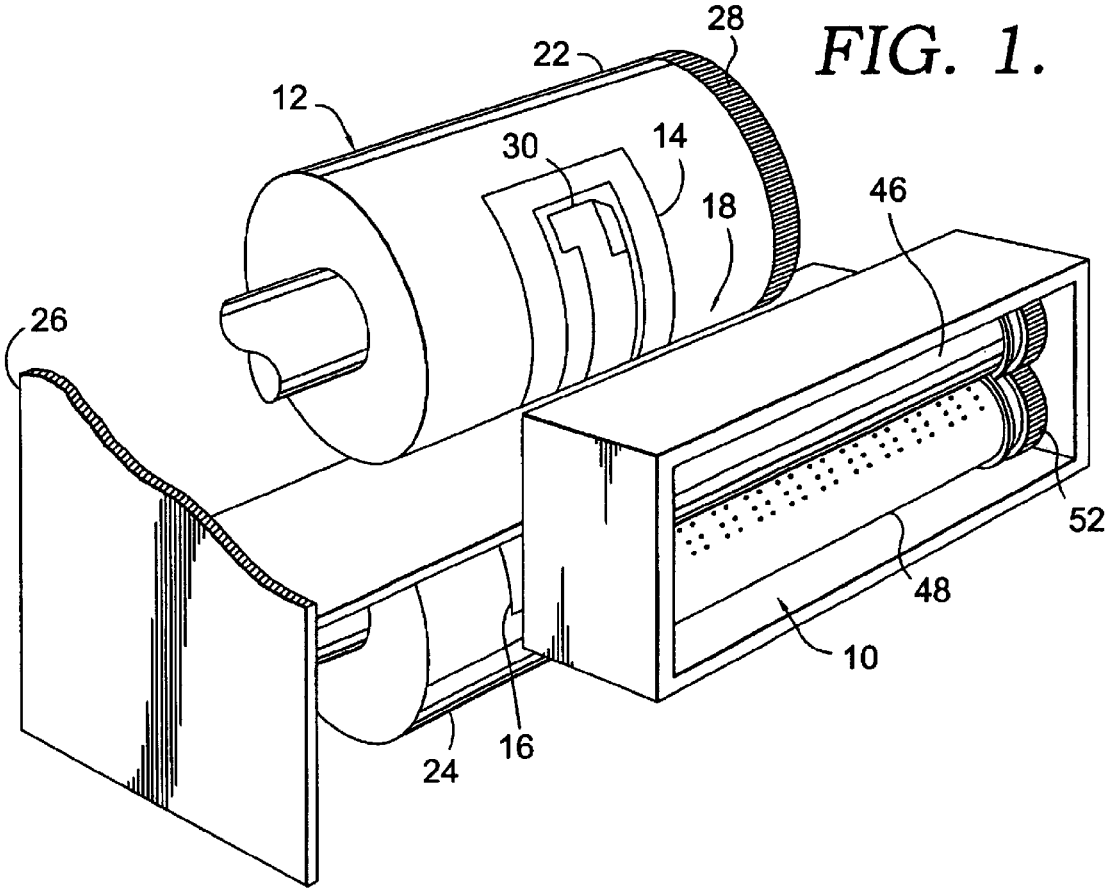
FIG. 1 is a perspective view having portions broken away to show a cutting mechanism and a separating mechanism according to the present invention.

Referring now to the drawings in detail, and initially to FIG. 1, numeral 10 generally designates a separating mechanism constructed in accordance with a first embodiment of the present invention. A web or sheet is typically fed into a cutting mechanism 12 where a male and female die 14, 16 cut the sheet into a blank in the shape of a folding carton, envelope, or other desired pattern. When the desired blank is formed, a skeleton or waste portion surrounding the blank remains. In some cases, a portion of the skeleton may also be located within the periphery of the blank, for example, if a window portion is to be included in the blank. An intermediate guide assembly 18 is used to maintain the position of the blank and skeleton relative to one another as they advance from the cutting mechanism 12 to the separating mechanism 10. Separating mechanism 10 then separates the skeleton from the blank by coupling the skeleton to a part of separating mechanism 10, as will be described below.

As best seen in FIG. 1, cutting mechanism 12 includes top and bottom rolls 22, 24 that are rotatably mounted to a main housing 26, which remains stationary throughout the manufacturing process. Top and bottom rolls 22, 24 are disposed in a manner which allows them to rotate with respect to each other, and are separated from one another at a distance which allows the sheet or web to pass therebetween while being cut by the dies 14, 16, as will be discussed below. In one embodiment, rolls 22, 24 include a plurality of splines 28 radially disposed about one circumferential edge of each roll, whereby the splines 28 of each roll 22, 24 engage each other and thereby rotate the rolls 22,24 with respect to each other. However, the manner by which the top and bottom rolls 22,24 rotate can be any suitable method for rotation. Typically, rolls 22,24 are formed of a magnetic material for coupling male and female dies 14, 16, respectively, thereto. It will be understood and appreciated that any suitable mechanical fasteners, adhesives or the like may alternatively be used to couple dies 14, 16 to rolls 22, 24.

Dies 14, 16 are generally used to cut the sheet or web into the blank or shape of the folding carton, envelope, or other desired product. In particular, male die 14 includes a raised peripheral portion 30 arranged in the shape of the desired blank. Female die 16 has a corresponding raised portion which extends from its surface and includes a medial channel therewithin, which medial channel is adapted to receive raised portion 30 when the two dies 14, 16 converge to cut the blank. In use, when the sheet passes between dies 14, 16, the desired blank is cut into the sheet as the peripheral portion 30 of die 14 is received in the corresponding medial channel of die 16.

Figure 7:
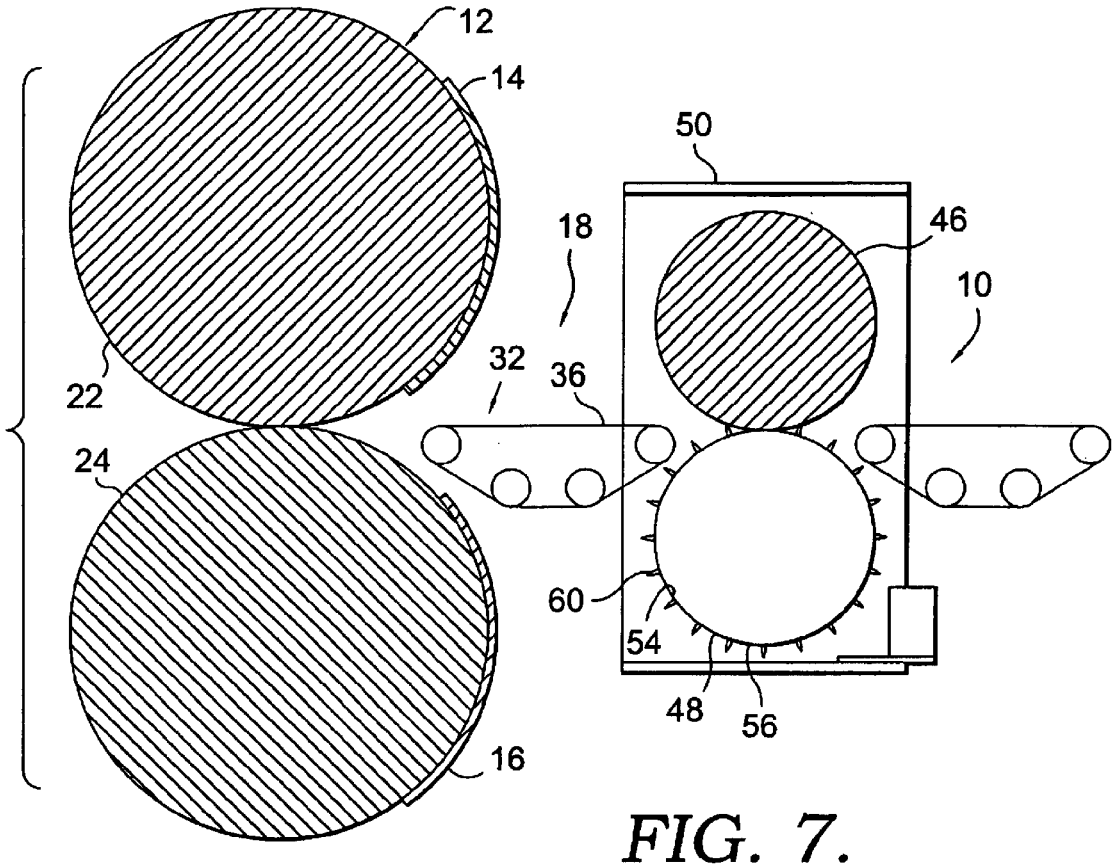
FIG. 7 is schematic view of the cutting mechanism, intermediate guide assembly and separating mechanism of the present invention.

Positioned between the cutting mechanism 12 and the separating mechanism 10 is intermediate guide assembly 18 which is adapted to support the blank and skeleton as they advance therebetween. Guide assembly 18 is best seen by reference to FIG. 7. Guide assembly 18 can be any suitable conveyor system which typically includes a transport surface 32 mounted to housing 26 by any suitable means. Guide assembly 18 can further include a plurality of longitudinally spaced conveyor belts or a plurality of guide rollers which transport the blank and skeleton from the cutting mechanism 12 to the separating mechanism 10, while keeping the blank and skeleton in registration with one another.

In operation, the blank and the skeleton advance from cutting mechanism 12 toward separating mechanism 10 by means of intermediate guide assembly 18. The blank and skeleton are retained firmly in place on the transport surface 32, and move in registration with each other, assuring that they will be properly positioned when they reach separation mechanism 10, the importance of which will be discussed below.

Figure 2:
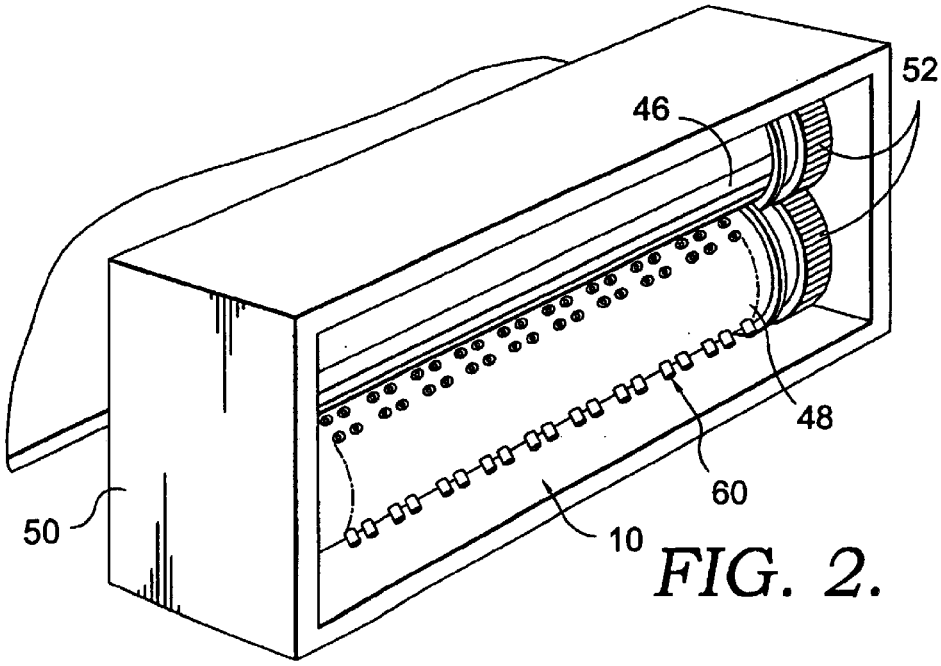
FIG. 2 is an enlarged fragmentary perspective view of the separating mechanism with a plurality of two-piece pin and sleeve assemblies mounted to a bottom separating cylinder.

As best seen in FIG. 2, separating mechanism 10 includes top and bottom separating cylinders 46, 48 rotatably mounted to a secondary housing 50, which remains stationary throughout the manufacturing process. Top and bottom cylinders 46, 48 are separated from one another at a distance that will allow the blank and skeleton to pass therebetween as they advance from intermediate guide assembly 18. Cylinders 46, 48 are further disposed in a manner which allows them to rotate with respect to each other. In one embodiment, cylinders 46, 48 include a plurality of splines 52 radially disposed about one circumferential edge of each cylinder, whereby the splines 52 of each cylinder 46, 48 engage each other and allow the cylinders 46, 48 to rotate with respect to each other. It is understood that any suitable means for causing cylinders 46, 48 to rotate is within the scope of this invention.

Figure 4:
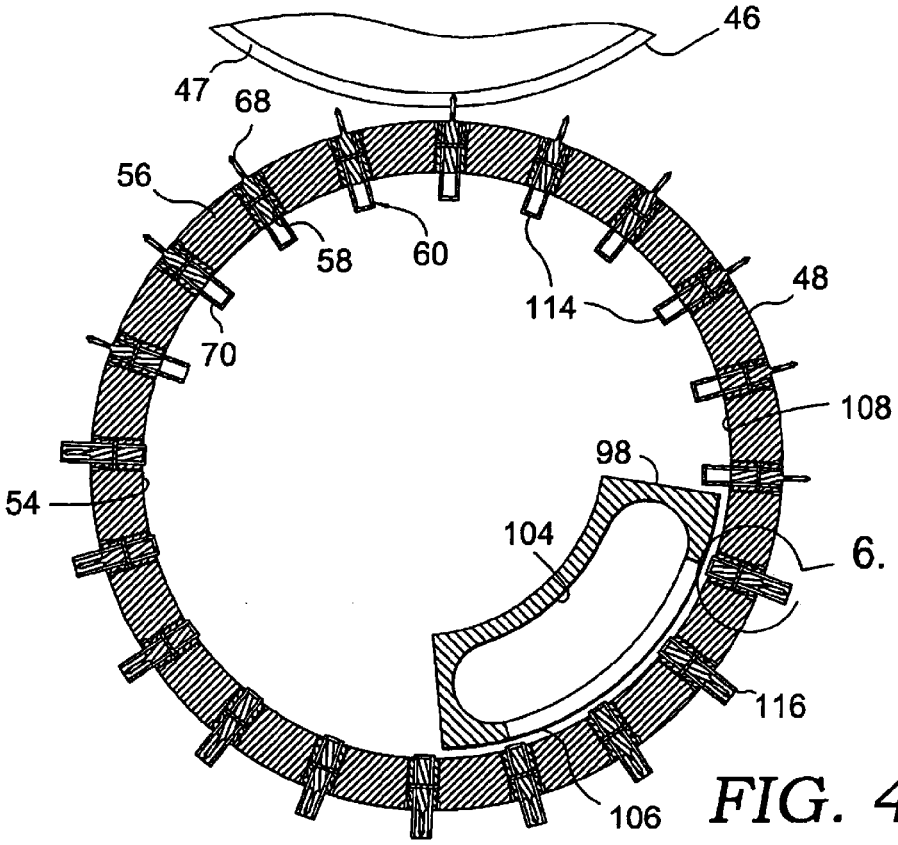
FIG. 4 is an enlarged cross-sectional view taken along line 4—4 of FIG. 3 showing the bottom separating cylinder with the tube or hollow bar mounted therein.

Referring now to FIG. 4, top cylinder 46 includes an outer surface 47 made of a resilient material which is adapted to be punctured or partially deformed by a pin or the like without being damaged in the process. As will be discussed below, this characteristic is essential to the separation process. Bottom separating cylinder 48 has a hollow interior portion 54 defined by an outer wall 56. One or more apertures 58 may formed in outer wall 56 so that one or more pin and sleeve assemblies 60 may be mounted to bottom separating cylinder 48. Specifically, with additional reference to FIG. 6, threads 62 are formed within aperture 58 and are used to secure pin and sleeve assembly 60 within wall 56.

Figure 6:
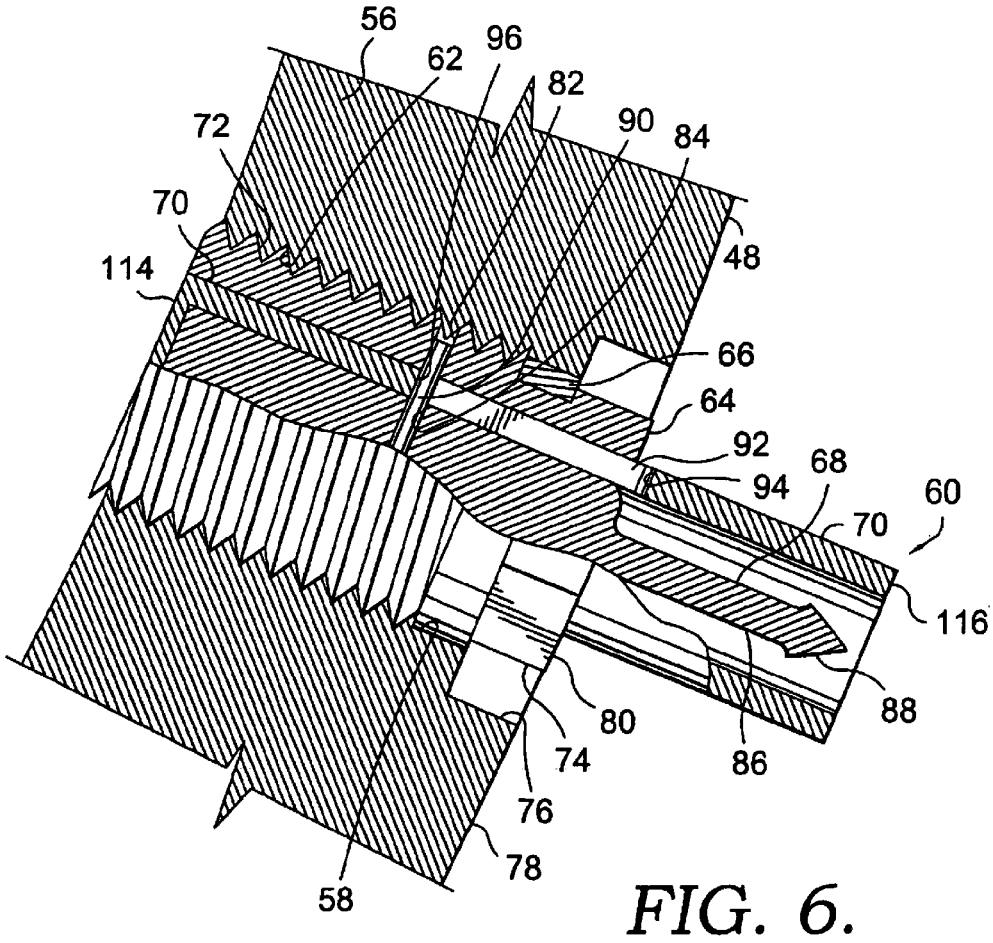
FIG. 6 is an enlarged view of the area encompassed by line "6" in FIG. 4 showing one of the pin and sleeve assemblies mounted to the bottom separating cylinder.

As best seen in FIGS. 4 and 6, pin and sleeve assemblies 60 are radially positioned about the circumference of bottom separating cylinder 48 and include a base 64, a ring 66, a pin 68 and a sleeve 70. Base 64 is generally cylindrical and has a threaded portion 72 which is adapted to mesh with corresponding threads 62 to secure pin and sleeve assembly 60 to bottom separating cylinder 48. A fastener 74 is fixedly mounted to the outer end of base 64 and may be positioned within a recess 76 formed in an outer surface 78 of bottom separating cylinder 48. Recess 76 is of a depth sufficient to allow an outer surface 80 of fastener 74 to be flush with, or positioned below, outer surface 78 of bottom separating cylinder 48. A pair of opposing channels 82 are formed in opposite sides of base 64 and extend in a direction transverse the longitudinal axis of base 64. In addition, channels 82 are adapted to be aligned with a channel 84 formed in pin 68. Ring 66 has a threaded inner surface which may be engaged with threaded portion 72 and positioned adjacent to fastener 74.

Pin 68 is positioned within base 64 and is sized so that there is a cylindrical channel formed between pin 68 and base 64 to allow sleeve 70 to fit slidably therebetween. An upper portion 86 of pin 68 extends beyond outer surface 78 of bottom separating cylinder 48 and includes a pointed end 88. Pointed end 88 is used to penetrate the waste material produced in the folding carton or envelope manufacturing process and couple the waste material to pin and sleeve assembly 60. A rod 90 is secured within channels 82, 84 and is used to fixedly position pin 68 relative to base 64.

Sleeve 70 is slidably mounted between base 64 and pin 68 and may be selectively moved between retracted and extended positions to selectively couple or release the waste material from upper portion 86 of pin 68. In particular, an elongated slot 92 is formed in sleeve 70 and includes a forward edge 94 and a rear edge 96. Rod 90 is positioned transversely through slot 92, thereby allowing sleeve 70 to slide outwardly to the extended position only to a point where rod 90 comes into contact with rear edge 96. Further, sleeve 70 may slide inwardly towards interior portion 54 of bottom separating cylinder 48 to the retracted position only to a point where rod 90 comes into contact with forward edge 94. In addition, sleeve 70 includes a closed bottom end 114.

Figure 3:
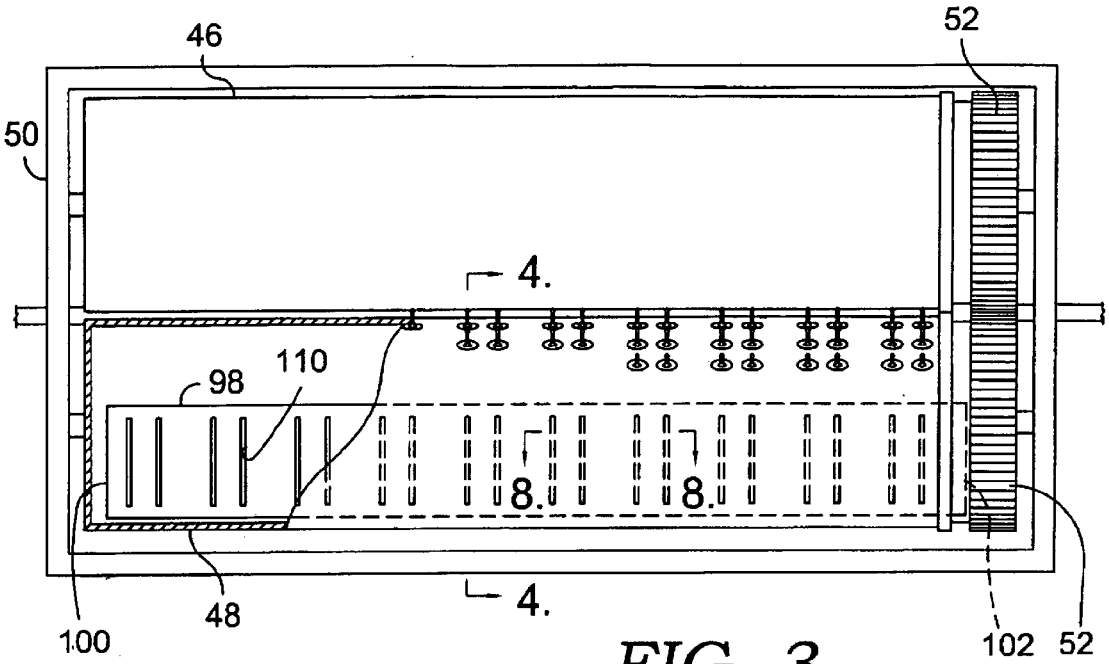
FIG. 3 is an enlarged elevational view of the separating mechanism having portions broken away to show a tube or hollow bar positioned within an interior portion of the bottom separating cylinder, with a portion of the tube shown in phantom lines.

As best seen in FIGS. 3 and 4, a tube or hollow air bar 98 is positioned within interior portion 54 of bottom separating cylinder 48 and has first and second ends 100, 102. A passage 104 is formed within air bar 98 and may extend along a substantial length of air bar 98. Passage 104 has at least a partially open portion at first and second ends 100, 102 and is in fluid communication with an air source such as an air compressor, not shown, or other type of device that is capable of forcing a fluid through first and second ends 100, 102. The scope of this invention contemplates that in addition to compressed air, the fluid can be any suitable fluid, including a liquid. An exterior surface 106 of air bar 98 may be formed to correspond with the shape of an inner surface 108 of bottom separating cylinder 48. It is within the scope of the present invention to form inner surface 108 into shapes and sizes other than those depicted in the FIGS. Exterior surface 106 is positioned to be only slightly spaced from inner surface 108, creating appropriate tolerances for efficient operation. In one embodiment, it is contemplated that a clearance of 1/1000" is acceptable. One or more apertures or slots 110 may be formed in air bar 98 and extend from exterior surface 106 to passage 104. Apertures 110 are approximately ten degrees in length relative to the circumference of second separating cylinder 48, but it will be understood that apertures 110 may be other lengths as well. Further, with specific reference to FIG. 3, apertures 110 may be positioned so that they are generally in alignment with pin and sleeve assemblies 60 that are mounted to bottom separating cylinder 48.

Figure 8:
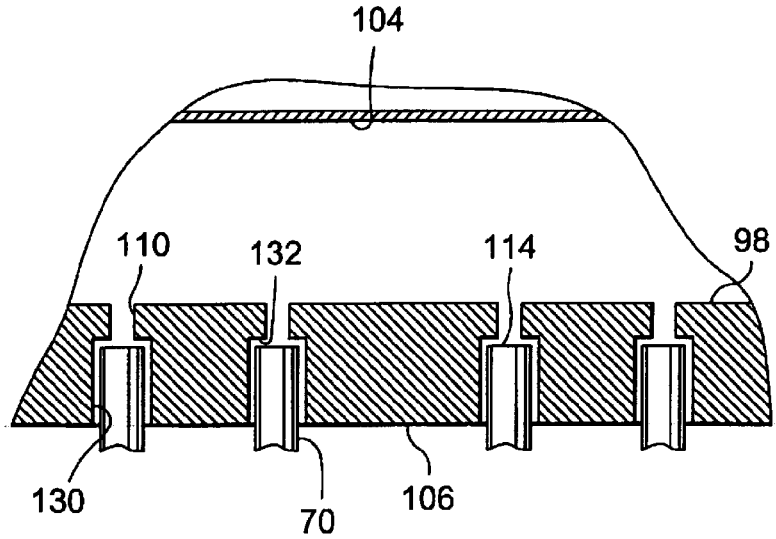
FIG. 8 is a schematic cross-sectional view of the compressed air being delivered to the bottom of the pins.

With reference to FIG. 8, it can be seen that air bar 98 has a plurality of transverse grooves 130 having bottom walls 132 in which apertures 110 are formed. The grooves 130 approximate with minimal clearance the width of sleeve 70 of pin and sleeve assembly 60. As bottom separating cylinder 48 rotates, the bottom portion of sleeve 70 can fit within the grooves 130 with sufficient clearance to assure that there will be no friction between the sleeve 70 and the inner wall of the grooves 130. Aperture 110 is in fluid communication with passage 104, which in turn is in fluid communication with the compressed air or other fluid from the fluid source. By concentrating the air or fluid flow from passage 104 through aperture 110, the compressed air has sufficient force with which to contact bottom surface 114 of sleeve 70, and slide sleeve 70 from the retracted position to the extended position, thereby concealing the upper portion 86 and pointed end 88 of pin 68, and forcing any coupled skeleton or waste material off of pin 68.

In operation, a web or sheet is first fed through and cut by cutting mechanism 12. Specifically, bottom roll 24 is rotated in a clockwise direction by a main drive gear, not shown, which is in turn rotated by a power source. As bottom roll is rotated, the splines 28 on top and bottom rolls 22, 24 engage each other, and top roll 22 is thereby rotated in a counterclockwise direction. The rotation of top and bottom rolls 22,24 operates to feed the web or sheet therebetween, and as the dies 14, 16 come into contact with each other, the sheet is cut by the action of raised peripheral portion 30 and the corresponding medial channel of die 16, thereby forming the desired blank and the skeleton or waste product. As stated above, the skeleton may surround the blank, or may also be located within the blank if a window portion is to be formed in the blank. It is understood that in certain circumstances, the skeleton may be located solely within the blank. It is further understood that bottom roll 24 could be rotated in a counterclockwise direction, thereby causing top roll 22 to rotate in a clockwise direction.

The intermediate guide assembly 18 retains the blank and skeleton in registration with one another as they advance between cutting mechanism 12 and the separating mechanism 10. Specifically, the blank and the skeleton advance from cutting mechanism 12 toward separating mechanism 10 by means of the conveyor system of guide assembly 18, assuring that they will be properly positioned when they reach separation mechanism 10. It is critical that the blank and skeleton are in proper registration so that when they reach the pin assembly 60, the precisely positioned pins 68 pierce the skeleton only, and not any portion of the blank. If the blank and skeleton do not move together, there is a chance not only that the skeleton may fail to be removed, but also that the blank may be pierced by pins 68 and consequently ruined.

The blank and skeleton are then fed into separating mechanism 10. Bottom separating cylinder 48 may rotated in a clockwise direction by the same main drive gear that rotates the top and bottom rolls 22, 24 in cutting mechanism 12. Splines 52 on cylinders 46,48 engage each other, and top separating cylinder 46 is thereby rotated in a counterclockwise direction. The rotation of top and bottom separating cylinders 46, 48 operates to advance the blank and skeleton therebetween. One or more pin tips 88 then pierce the skeleton adjacent the region at which the cylinders 46, 48 are closest together. Specifically, as best seen in FIG. 4 where top and bottom separating cylinders 46, 48 are closest together, sleeve 70 is in the retracted position to expose pin 68 and allow it to penetrate and couple the waste material to bottom separating cylinder 48. As will be understood, pin tip 88 also at least partially pierces or partially deforms the outer surface 47 of top separating cylinder 46, providing the resistance needed for tip 88 to fully pierce the skeleton. At this point, the blank and skeleton separate from each other as the blank continues to advance through the manufacturing process, while bottom separating cylinder 48 advances the skeleton toward air bar 98.

Figure 5:
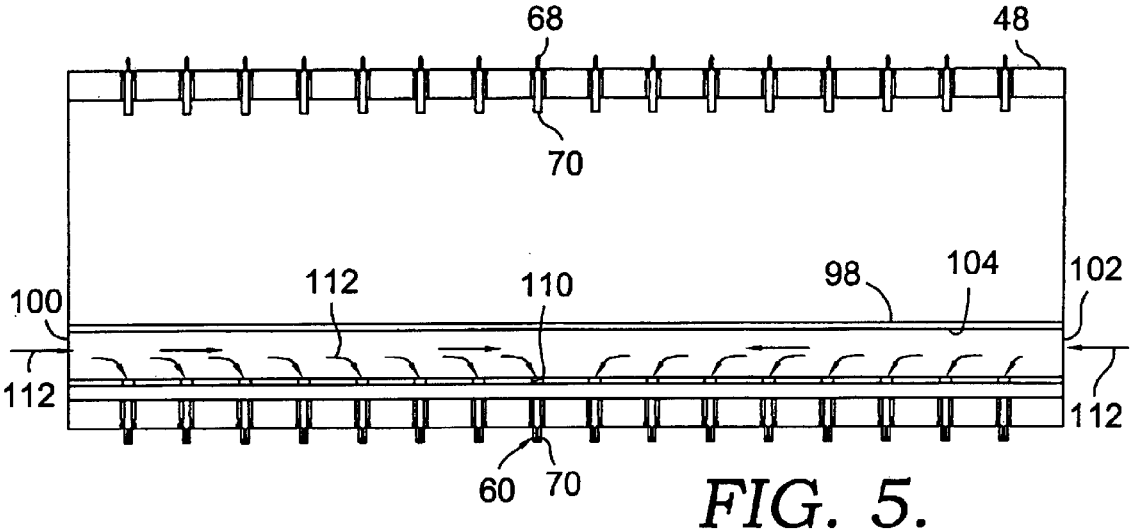
FIG. 5 is a schematic view of the bottom separating cylinder showing compressed air or other fluid flowing into both ends of the tube and out of a plurality of slots formed in the tube.

With reference to FIG. 5, as one or more pin and sleeve assemblies 60 and the waste material move toward air bar 98, the compressor or a similar device operates to force air or other suitable fluid into first and second ends 100, 102 of air bar 98, causing the air or other fluid to flow through passage 104 and out of one or more of apertures 110 as depicted by the arrows labeled with numeral 112. It is also within the scope of the present invention to force air through just one of first and second ends 100, 102. Furthermore, as stated above, it will be understood that utilizing other types of fluids instead of air or compressed air is also within the scope of the present invention.

As best seen in FIG. 4, the air that is forced through apertures 110 contacts closed bottom end 114 and thereby forces sleeve 70 to move from the retracted position to the extended position. Specifically, the air flows out of apertures 110 and applies a force on bottom surface 114 of sleeve 70, thereby causing sleeve 70 to slide radially outwardly relative to outer surface 78 of bottom separating cylinder 48. Sleeve 70 continues to slide outwardly until rod 90 contacts rear edge 96 of slot 92. When in a fully extended position, an external rim 116 of sleeve 70 may be positioned at the same or a slightly greater distance from outer surface 78 as pointed end 88, fully concealing pin 68. As sleeve 70 is moved from the retracted position to the extended position, the forward edge of external rim 116 contacts and operates to slide or strip the waste material off of upper portion 86 of pin 68. After being removed from pin and sleeve assembly 60, the waste material is discarded by means of waste removal assembly and is ultimately deposited into a waste area (not shown), while the separated blank is removed by means of blank removal assembly (not shown).

Sleeve 70 remains in the extended position after waste material is removed from bottom separating cylinder 48 due to gravity. Bottom separating cylinder 48 continues to rotate in a clockwise direction, and as the pin and sleeve assembly 60 having an extended sleeve approaches top separating cylinder 46, the force of gravity causes such extended sleeve 70 to slide into the retracted position, wherein rod 90 is in contact with forward edge 94 of sleeve 70. Thus, upper portion 86 of pin 68 is exposed and in a position to penetrate and couple the waste material to bottom separating cylinder 48.

It can, therefore, be seen that the invention is one that is designed to utilize a concentrated stream of compressed air or other suitable fluid to move the sleeve of a two-piece pin and sleeve assembly from a retracted position to an extended position, whereby the waste material is stripped from the pin and thus removed from the bottom separating cylinder.

While particular embodiments of the invention have been shown, it will be understood, of course, that the invention is not limited thereto, since modifications may be made by those skilled in the art, particularly in light of the foregoing teachings. Reasonable variation and modification are possible within the scope of the foregoing disclosure of the invention without departing from the spirit of the invention.

What is claimed is:

1. A device for separating and stripping waste material from a blank during a manufacturing process, said device comprising:

a first and a second rotatable cylinder, said cylinders positioned so that the surfaces of the cylinders are horizontal and aligned so that waste material may pass therebetween when said cylinders rotate;

a pin and sleeve assembly coupled to the second cylinder, the pin and sleeve assembly including a pin extending through the surface of the second cylinder and adapted to couple waste material to the second cylinder, the pin and sleeve assembly further including a sleeve that is selectively slidable between a retracted position in which the pin is exposed and an extended position in which the pin is concealed; and a tube positioned within an interior portion of the second cylinder and having at least one aperture formed therein, the aperture directed generally radially outwardly so that when the second cylinder rotates the pin and sleeve assembly past the aperture, fluid flowing through the aperture will force the sleeve of the pin and sleeve assembly to slide from the retracted position to the extended position and thereby remove any waste material coupled to the pin.

2. The device of claim 1, wherein the sleeve includes a closed bottom portion, and wherein the aperture is generally aligned with the closed bottom portion of the sleeve.

3. The device of claim 1, wherein the tube extends across a substantial length of the second cylinder.

4. The device of claim 1, wherein the aperture is about 10 degrees in length relative to the circumference of the second cylinder.

5. The device of claim 1, wherein the tube is adapted to receive a fluid from a fluid source, and direct the fluid through the aperture.

6. The device of claim 5, wherein the fluid is compressed air.

7. A device for stripping waste material from a separating mechanism during a manufacturing process, the separating mechanism including first and second rotatable cylinders, and a pin and sleeve assembly is coupled to the second cylinder, said device comprising:

a tube positioned within an interior portion of the second separating cylinder and in fluid communication with a fluid source, the tube having at least one aperture formed therein, the aperture directed generally radially outwardly so that when the second cylinder rotates, fluid flowing through the aperture will impact on the sleeve and thereby force the removal of any waste material coupled to the pin and sleeve assembly.

8. The device of claim 7, wherein the pin and sleeve assembly includes a pin and a sleeve slidably coupled therewith, the sleeve being selectively slidable between a retracted position in which the pin is exposed, and an extended position in which the pin is concealed, wherein the fluid flowing through the aperture is adapted to move the sleeve from the retracted position to the extended position to thereby conceal the pin.

9. The device of claim 7, wherein the sleeve includes a closed bottom portion, and wherein the aperture is generally aligned with the closed bottom portion of the sleeve.

10. The device of claim 7, wherein the tube extends across a substantial length of the second cylinder.

11. The device of claim 7, wherein the aperture is about 10 degrees in length relative to the circumference of the second cylinder.

12. The device of claim 7, wherein the tube is adapted to receive a fluid from a fluid source, and direct the fluid through the aperture.

13. The device of claim 7, wherein said fluid is compressed air.

14. A device for separating and stripping waste material from a blank a during manufacturing process, the device comprising:

a first and second rotatable cylinders, the second cylinder having an interior portion;

a pin and sleeve assembly coupled to the second cylinder, the pin and sleeve assembly including a pin adapted to couple the waste material to the second separating cylinder and a sleeve slidably coupled therewith, the sleeve being selectively slidable between a retracted position in which the pin is exposed, and an extended position in which the pin is concealed; and a tube positioned within the interior portion of the second separating cylinder and extending across a substantial length thereof, the tube having at least one aperture generally aligned with the pin and sleeve assembly, the tube adapted to receive a fluid from a fluid source and direct the fluid through the aperture to move the sleeve from the retracted position to the extended position to thereby conceal the pin.

15. A device for stripping waste material from a separating mechanism, the separating mechanism including first and second cylinders, wherein a pin and sleeve assembly is coupled to the second cylinder and includes a pin and a sleeve, the pin adapted to couple the waste material with the second separating cylinder, the sleeve being selectively slidable between a retracted position in which the sleeve is positioned within the second cylinder and in which the pin is exposed, and an extended position in which the sleeve extends in a radial direction from the surface of the second cylinder and in which the pin is concealed, the device comprising:

means for receiving a fluid and for directing the fluid against the sleeve to slide the sleeve from its concealed position to its extended position.

16. A method for separating and stripping waste material from a blank, the method comprising:

providing a separating mechanism having first and second rotatable cylinders;

providing a pin and sleeve assembly coupled to the second cylinder, the pin and sleeve assembly having a pin and a sleeve slidably coupled therewith, the sleeve being selectively slidable between a retracted position in which the pin is exposed, and an extended position in which the pin is concealed;

providing a tube having at least one aperture formed therein, wherein the aperture is generally aligned with the pin and sleeve assembly;

coupling the waste material to said pin; and forcing a fluid to flow into the tube and through the aperture to cause the sleeve to slide from the retracted position to the extended position to thereby conceal the pin and strip the waste material from the second separating cylinder.

* * * * *